US005265429A

United States Patent [19]

Dray

[11] Patent Number: 5,265,429

[45] Date of Patent: Nov. 30, 1993

[54] CRYOGENIC AIR SEPARATION SYSTEM FOR PRODUCING GASEOUS OXYGEN

[75] Inventor: James R. Dray, Kenmore, N.Y.

[73] Assignee: Praxair Technology, Inc., Danbury, Conn.

[21] Appl. No.: 838,894

[22] Filed: Feb. 21, 1992

[51] Int. Cl.[5] ..... F25J 3/02

[52] U.S. Cl. ..... 62/41; 62/22; 62/24; 62/25; 62/38

[58] Field of Search ..... 62/22, 24, 13, 25, 37, 62/38, 40, 41, 42

[56] References Cited

U.S. PATENT DOCUMENTS

| | | | |
|---|---|---|---|
| 2,708,831 | 5/1955 | Wilkinson | 62/122 |
| 3,056,268 | 10/1962 | Grenier | 62/19 |
| 3,058,315 | 10/1962 | Schuftan | 62/52 |
| 3,059,440 | 10/1962 | Loporto | 62/41 |
| 3,110,155 | 11/1963 | Schuftan | 62/41 X |
| 3,174,293 | 3/1965 | Jakob et al. | 62/39 |
| 3,273,349 | 9/1966 | Litvin et al. | 62/50 |
| 3,319,434 | 5/1967 | Matesanz | 62/45 |
| 3,371,496 | 3/1968 | Seidel | 62/13 |
| 3,485,053 | 12/1969 | Grenier | 62/37 X |
| 3,605,422 | 9/1971 | Pryor et al. | 62/37 X |
| 4,133,662 | 1/1979 | Wagner | 62/13 |
| 4,303,428 | 12/1981 | Vandenbussche | 62/38 X |
| 4,529,425 | 7/1985 | McNeil | 62/37 |
| 4,555,256 | 11/1985 | Skolaude et al. | 62/25 X |
| 4,668,260 | 5/1987 | Yoshino | 62/40 X |
| 4,698,079 | 10/1987 | Yoshino | 62/42 X |
| 4,705,548 | 11/1987 | Agrawal et al. | 62/38 X |
| 4,715,873 | 12/1987 | Auvil et al. | 62/38 X |
| 4,732,597 | 3/1988 | Jujasz et al. | 62/41 X |
| 4,822,395 | 4/1989 | Cheung | 62/41 X |
| 4,883,518 | 11/1989 | Skolaude et al. | 62/38 |
| 5,074,898 | 12/1991 | Cheung | 62/38 |
| 5,082,482 | 1/1992 | Darredeau | 62/24 |
| 5,084,081 | 1/1992 | Rohde | 62/22 |
| 5,098,456 | 3/1992 | Dray et al. | 62/38 X |
| 5,152,149 | 10/1992 | Mostello et al. | 62/41 X |

OTHER PUBLICATIONS

Springmann, Variable Oxygen Supply Systems, ASME, Cryogenic Processes and Equipment, pp. 137-141, Dec. 9, 1984.

*Primary Examiner*—Henry A. Bennett
*Assistant Examiner*—Chris Kilner
*Attorney, Agent, or Firm*—Stanley Ktorides

[57] ABSTRACT

A cryogenic air separation system employing a product boiler coupled with a liquid air supply whereby liquid oxygen is effectively vaporized to produce gaseous oxygen product while providing for steady state operation of the cryogenic air separation plant without significant refrigeration loss.

6 Claims, 1 Drawing Sheet

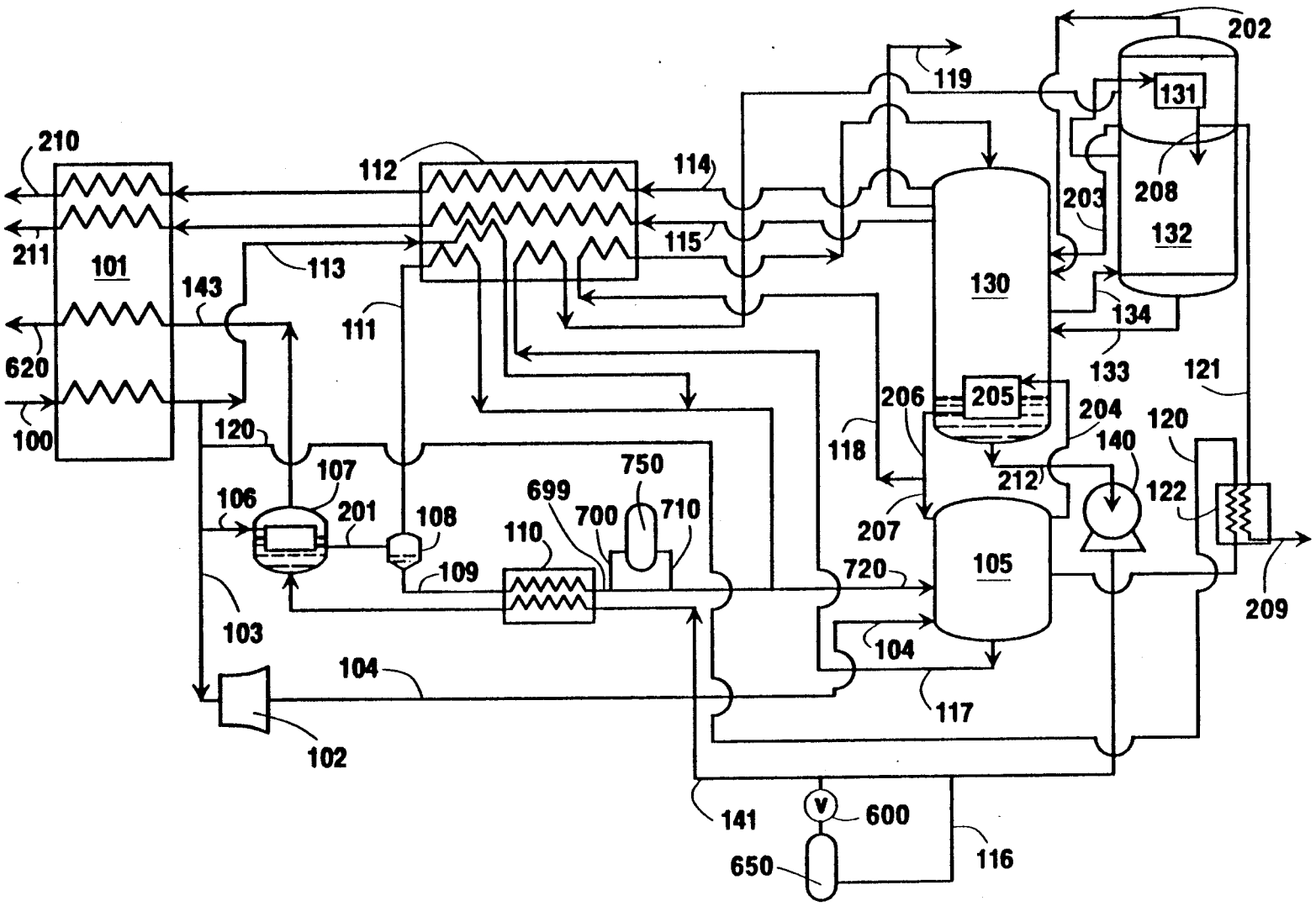
202
131
208
132
209
121
120
122
134
133
140
203
204
212
130
205
105
116
119
206
207
720
104
117
118
600
650
141
114
115
710
750
700
699
110
112
111
108
109
113
107
201
104
102
120
106
103
143
101
210
211
620
100

CRYOGENIC AIR SEPARATION SYSTEM FOR PRODUCING GASEOUS OXYGEN

TECHNICAL FIELD

This invention relates generally to the field of cryogenic air separation and, more particularly, to cryogenic air separation for producing gaseous oxygen product.

BACKGROUND ART

When large volumes of gaseous oxygen are required for a particular use, the gaseous oxygen is produced by the cryogenic rectification of air in a cryogenic rectification plant and piped directly from the plant to the use point. An air separation plant is designed to operate most efficiently at a certain steady state condition. However, the use point may require the gaseous oxygen under conditions of widely fluctuating demand.

In order to accomodate the countervailing requirements of the efficient steady state operation of the cryogenic rectification plant and the widely fluctuating gaseous oxygen demand of a use point, gaseous oxygen tanks are employed to store gaseous oxygen produced during periods of slack demand and from which gaseous oxygen may be withdrawn and passed to the use point during periods of high demand, thus serving to dampen operating rate fluctuations of the cryogenic air separation plant and thus maintain a high operating efficiency for the plant. A problem with such a system is that even though the gaseous oxygen is stored at high pressure, only a limited amount of gaseous oxygen may be stored in this manner without engaging a gaseous oxygen tank farm which would entail very high capital costs.

The limited storage capacity of backup oxygen may be overcome by storing the oxygen as liquid rather than gas. However, while solving the limited storage problem, this procedure has problems of its own. One problem is that removal of excess oxygen as liquid from the cryogenic rectification plant to be put into storage imposes a large refrigeration loss on the plant. Another problem is that maintaining the stored oxygen in liquid form requires energy input into the system, although this Problem is relatively minor in well insulated tanks. Still another problem is that further energy input is required to vaporize the liquid oxygen to form gaseous oxygen product.

Accordingly, it is an object of this invention to provide an improved cryogenic rectification system for producing gaseous oxygen which can more effectively employ liquid oxygen storage to alleviate or dampen fluctuations in a cryogenic rectification plant operating rate while still accommodating widely fluctuating usage demand for product gaseous oxygen.

SUMMARY OF THE INVENTION

The above and other objects which will become apparent to one skilled in the art upon a reading of this disclosure are attained by the present invention one aspect of which is:

A method for producing gaseous oxygen by the cryogenic rectification of feed air comprising:

(A) passing feed air into a product boiler and condensing feed air by indirect heat exchange with liquid oxygen in the product boiler;

(B) passing condensed feed air into a cryogenic rectification plant and producing liquid oxygen therein;

(C) passing liquid oxygen produced in the cryogenic rectification plant to the product boiler to carry out the condensation of the feed air, and recovering gaseous oxygen from the product boiler as product;

(D) passing liquid oxygen produced in the cryogenic rectification plant into a liquid oxygen tank to produce a supply of liquid oxygen;

(E) increasing the flow of liquid oxygen to the product boiler by passing liquid oxygen from the liquid oxygen supply to the product boiler and commensurately increasing the flow of feed air to the Product boiler to produce excess condensed feed air; and (F) passing excess condensed feed air into a liquid air tank to produce a supply of liquid air.

Another aspect of the invention comprises:

A cryogenic air separation plant for producing gaseous oxygen comprising:

(A) a product boiler, means for supplying feed air into the product boiler, and means for passing liquid from the Product boiler to a cryogenic rectification plant;

(B) means for passing liquid from the cryogenic rectification plant into the product boiler and means for recovering gaseous product from the product boiler;

(C) a liquid oxygen tank, means for passing liquid from the cryogenic rectification plant into the liquid oxygen tank, and means for passing liquid from the liquid oxygen tank into the product boiler; and (D) a liquid air tank, means for passing liquid from the product boiler into the liquid air tank, and means for passing liquid from the liquid air tank into the cryogenic rectification plant.

As used herein, the term "product boiler" means a heat exchanger wherein liquid oxygen is boiled by indirect heat exchange with condensing air vapor.

As used herein the term, "column", means a distillation or fractionation column or zone, i.e., a contacting column or zone wherein liquid or vapor phases are countercurrently contacted to effect separation of a fluid mixture, as for example by contacting of the vapor and liquid phases on a series of vertically spaced trays or plates mounted within the column and/or on packing elements which may be structured and/or random packing elements. For a further discussion of distillation columns see the Chemical Engineers' Handbook, Fifth Edition, edited by R. H. Perry and C. H. Chilton, McGraw-Hill Book Company, New York, Section 13, "Distillation" B. D. Smith et al, page 13-3, *The Continuous Distillation Process.* The term, double column is used to mean a higher pressure column having its upper end in heat exchange relation with the lower end of a lower pressure column. A further discussion of double columns appears in Ruheman "The Separation of Gases" Oxford University Press, 1949, Chapter VII, Commercial Air Separation.

Vapor and liquid contacting separation Processes depend on the difference in vapor pressures for the components. The high vapor pressure (or more volatile or low boiling) component will tend to concentrate in the vapor phase whereas the low vapor Pressure (or less volatile or high boiling) component will tend to concentrate in the liquid phase. Distillation is the separation process whereby heating of a liquid mixture can be used to concentrate the volatile component(s) in the vapor Phase and thereby the less volatile component(s) in the liquid phase. Partial condensation is the separation process whereby cooling of a vapor mixture can be used to concentrate the volatile component(s) in the vapor phase and thereby the less volatile component(s) in the liquid phase. Rectification, or continuous distillation, is the separation process that combines successive partial vaporizations and condensations as obtained by a countercurrent treatment of the vapor and liquid phases. The countercurrent contacting of the vapor and liquid phases is adiabatic and can include integral or differential contact between the phases. Separation process arrangements that utilize the principles of rectification to separate mixtures are often interchangeably termed rectification columns, distillation columns, or fractionation columns. Cryogenic rectification is a rectification Process carried out, at least in part, at low temperatures, such as at temperatures at or below 125 degrees K.

As used herein the term "indirect heat exchange" means the bringing of two fluid streams into heat exchange relation without any physical contact or intermixing of the fluids with each other.

As used herein the term "argon column" means a system comprising a column and a top condenser which processes a feed comprising argon and produces a product having an argon concentration which exceeds that of the feed.

BRIEF DESCRIPTION OF THE DRAWING

The sole Figure is a schematic representation of one preferred embodiment of the cryogenic rectification system of this invention wherein the cryogenic rectification plant comprises a double column with an associated argon column.

DETAILED DESCRIPTION

The invention comprises in general the use of a product boiler to effectively generate gaseous oxygen product from liquid oxygen coupled with the use of a liquid air storage tank between the product boiler and the cryogenic rectification to simultaneously address both the loss of refrigeration caused by liquid oxygen withdrawal from, and operating rate fluctuations of, the cryogenic rectification plant.

The invention will be described in detail with reference to the Drawing. Referring now to the Figure, feed air 100 which has been cleaned of low boiling impurities such as carbon dioxide and water vapor, is cooled by passage though heat exchanger 101 by indirect heat exchange with return streams. A fraction 113 is condensed by partial traverse of heat exchanger 112 and then passed as part of stream 720 into the cryogenic air separation plant. Another portion 120 of the feed air is condensed against argon product in heat exchanger 122 and then passed into a column of the cryogenic rectification plant. A third fraction 103 of the feed air is turboexpanded through turboexpander 102 to generate refrigeration and resulting turboexpanded stream 104 is passed, like the other feed air fractions, into column 105 of the air separation plant.

Fraction 106, which comprises from 10 to 50 percent of the flowrate of feed air 100, is passed into product boiler 107 wherein it is at least partially condensed by indirect heat exchange with boiling liquid oxygen. If the resulting feed air fraction 201 contains vapor as well as liquid, stream 201 may be passed into phase separator 108 for separation into vapor and liquid. Vapor 111 is condensed by partial traverse of heat exchanger 112 and passed into column 105 as part of stream 720. Liquid or condensed feed air 109 is further cooled by indirect heat exchange with liquid oxygen in heat exchanger 110 and resulting stream 699 is combined with steam 720 and passed into column 105.

Column 105 is the higher pressure column of a double column cryogenic air separation plant and is operating at a pressure generally within the range of from 60 to 90 pounds per square inch absolute (psia). Within column 105 the feeds into the column are separated by cryogenic rectification into nitrogen-enriched vapor and oxygen-enriched liquid. Oxygen-enriched liquid is passed in stream 117 from column 105, further cooled by partial traverse of heat exchanger 112 and passed into top condenser 131 of argon column 132 wherein it is partially vaporized against condensing crude argon vapor. The resulting vapor and remaining liquid are passed from top condenser 131 into column 130 as streams 202 and 203 respectively. Nitrogen-enriched vapor is passed from column 105 as stream 204 into main condenser 205 wherein it is condensed by indirect heat exchange with reboiling column 130 bottoms. Resulting nitrogen-enriched liquid 206 is divided into at least two streams 118 and 207. Stream 207 is passed back into column 105 as reflux while stream 118 is cooled by partial traverse of heat exchanger 112 and then passed into column 130.

A stream 134 comprising primarily oxygen and argon is passed from column 130 into argon column 132 wherein it is separated by cryogenic rectification into crude argon vapor and oxygen-richer liquid which is passed back into column 130 as stream 133. Crude argon vapor, generally having an argon concentration of at least 95 percent, is condensed in top condenser 131 against oxygen-enriched liquid as was previously described. A portion 208 of resulting liquid crude argon is returned to column 132 as reflux while another portion 121 is vaporized by passage through heat exchanger 122 as was previously described, and is recovered as crude argon 209.

Column 130 is the lower pressure column of a double column air separation plant and is operating at a pressure less than that of column 105 and generally within the range of from 17 to 30 psia. Within column 130 the various feeds into the column are separated therein by cryogenic rectification into nitrogen-rich and oxygen-rich fluids. Nitrogen-rich vapor is removed from column 130 as stream 114, warmed by passage through heat exchangers 112 and 101, and may be recovered as gaseous nitrogen product stream 210. Generally the nitrogen product will have a purity of at least 99.99 percent. If desired, a stream of nitrogen-rich liquid 119 may be removed from column 130 and recovered as liquid nitrogen product. For product purity purposes a waste vapor stream 115 is removed from column 130 from a point below the point where stream 114 is removed from column 130, warmed by passage through heat exchanger 112 and 101 and passed out of the system as stream 211.

Oxygen-rich liquid, having an oxygen purity generally of at least 99.5 percent, is removed from column 130 as stream 212 and, if desired, pumped to a higher Pressure by passage through pump 140. In the case where the cryogenic rectification system does not comprise an argon column, oxygen-rich liquid may have a lower minimum purity such as 90 or 95 percent. Pressurized liquid oxygen stream 213 is then passed as stream 141 through heat exchanger 110 and is then passed into product boiler 107 wherein it is vaporized in order to carry out the aforedescribed condensation of feed air. Resulting gaseous oxygen stream 143 is warmed by passage through heat exchanger 101 and recovered as gaseous oxygen product stream 620. In the case where the product gaseous oxygen is passed directly to a use point, recovery of the gaseous oxygen encompasses the direct passage of stream 620 to the use point such as, for example, a steel mill.

During the times when the gaseous oxygen product demand is less than the rate at which liquid oxygen is produced, rather than reducing the operating rate of the cryogenic air separation plant, the plant may continue producing product at the design rate and excess liquid oxygen may be passed through stream 116 into liquid oxygen storage tank 650 to produce a supply of liquid oxygen. When the gaseous oxygen product demand exceeds the rate at which liquid oxygen is produced, the flow of liquid oxygen to the product boiler may be increased by passing liquid oxygen from the liquid oxygen supply in tank 650 through valve 600 and into line 141. In order to balance the heat exchange in product boiler 107, the flow of feed air into product boiler 107 is increased commensurately with the increased flow liquid oxygen. This results in the production of excess condensed feed air.

The invention couples a liquid air storage tank with the product boiler. By employing the product boiler to vaporize the liquid oxygen, significant energy in the form of heat need not be put into the system. The resulting refrigeration recovered from the vaporizing liquid oxygen is returned back into the cryogenic rectification plant. When excess liquid air is generated by the invention, the excess condensed feed air is passed in stream 700 into liquid air tank 750 to produce a supply of liquid air which, as needed to maintain the design operating rate of the cryogenic rectification plant, is passed through stream 710 and stream 720 into column 105. Although tanks 650 and 750 are illustrated in the Figure as being single tanks it is understood that either or both of these tanks could be a bank of tanks.

An important aspect of this invention is the liquid air tank 750. The subcooled liquid air stream 699 is fed by conduit to liquid air storage tank 750 and column 105. The flows through stream 700 and stream 710 are modulated to maintain the desired liquid air feed 720 to column 105. At steady state conditions the liquid oxygen addition flow 600 and liquid air feed 700 to tank 750 would be zero. When gaseous oxygen demand increase, the flow of streams 100, 106, 143, 600 and 700 increase to match demand while other plant flows can remain essentially constant. After gaseous oxygen demand decreases, the flow of streams 100, 106 and 143 are reduced to slightly below their steady state values and streams 600 and 700 are reduced to zero. The reduction in air flow 106 to product boiler 107 will reduce the liquid air flow 699 from heat exchanger 110. Liquid air flow 710 is started from tank 750 to maintain a constant flow of liquid air 720 to column 105. The liquid oxygen stream 116 to storage tank 650 is increased to maintain constant column conditions.

The pressure of the oxygen stream 143 is determined by the pressure and flow of air stream 106, design of product boiler 107 and pressure of stream 141. Liquid pumps and/or dedicated tanks may be used to raise the pressure of stream 141 to the desired level. Liquid oxygen product can be sent directly to tank 650, or withdrawn from product boiler 107, subcooled in heat exchanger 112 and fed by conduit to external storage.

The ability to manipulate the pressure of gaseous oxygen stream 143 is a key advantage of this invention, especially when product oxygen compressors are used. High pressure oxygen gas is produced by vaporizing the liquid oxygen in the product boiler against the condensing high pressure feed air. Typical air separation plants produce oxygen product at a pressure which is determined by column operating pressure. To increase product pressure the entire column system pressures must be elevated, at considerable efficiency penalty. This invention enables the additional air compressor work to be converted to refrigeration in expander 102, without elevating the pressures in the column system. This increases net liquid production and eliminates physical constraints in the column system, such as the pressure rating of column 130.

The liquid air tank 750 further improves the process by allowing gaseous oxygen product to increase by additional feed from tank 650 without impacting column operation. This extends the working range of the system by decoupling the instantaneous gaseous oxygen production, average gaseous oxygen production and refrigeration balance. Liquid air storage allows the variables to be controlled independently. The liquid air tank also makes it easier to eliminate oxygen product venting since there is a ready source of refrigeration available when there are excess oxygen molecules. A typical system with receivers would require excess oxygen molecules to be vented when the receivers are full.

Increasing oxygen product compressor feed pressure is preferred over vaporizing liquid from storage to raise machine capacity during periods of high demand. During low demand periods the suction pressure at the oxygen compresssor can be reduced as far as possible to minimize energy consumption. In a typical air separation plant the pressure of the oxygen product stream is reduced by a throttling valve. The invention is more efficient because it allows the feed air pressure in stream 100 to be reduced as oxygen pressure requirements drop. The drop in feed air pressure reduces energy consumption.

Another useful application for this invention is in situations where there are large differences in energy costs on a time of day basis. It is possible to use air to provide the vapor driving force in product boiler 107, and send all the liquefied air to tank 750. The oxygen feed 142 to product boiler 107 would be taken entirely or mostly from storage tank 650 during the high energy cost periods. When energy costs are low the air flow would be increased and the distillation columns put in service. Liquid air from tank 750 would be supplied to column 130 as a source of molecules and refrigeration. The total oxygen production during the low power cost periods would be significantly higher than the average requirement. Liquid oxygen product in stream 116 would be produced in sufficient quantities to supply heat exchanger 107 when the distillation columns 105 and 130 were not in service.

Although the invention has been described in detail with reference to a certain preferred embodiment, those skilled in the art will recognize that there are other embodiments of the invention within the spirit and the scope of the claims.

I claim:

1. A method for producing gaseous oxygen by the cryogenic rectification of feed air comprising:

(A) passing a fraction of the feed air into a product boiler and condensing feed air by indirect heat exchange with liquid oxygen in the product boiler;

(B) passing condensed feed air into a cryogenic rectification plant comprising a higher pressure column and a lower pressure column and producing liquid oxygen therein;

(C) passing liquid oxygen produced in the cryogenic rectification plant to the product boiler to carry out the condensation of the feed air, and recovering gaseous oxygen from the product boiler as product;

(D) pumping liquid oxygen produced in the cryogenic rectification plant and thereafter passing the pumped liquid oxygen into a liquid oxygen tank to produce a supply of liquid oxygen;

(E) increasing the flow of liquid oxygen to the product boiler by passing liquid oxygen from the liquid oxygen supply to the product boiler and commensurately increasing the flow of feed air to the product boiler to produce excess condensed feed air;

(F) passing excess condensed feed air produced in the product boiler into a liquid air tank to produce a supply of liquid air while continuing to pass condensed feed air into the cryogenic rectification plant without passing through the liquid air tank; and (G) turboexpanding another fraction of the feed air and passing the turboexpanded feed air fraction into the higher pressure column.

2. The method of claim 1 further comprising passing an argon-containing fluid from the cryogenic rectification plant into an argon column and recovering an argon fluid having an argon concentration of at least 95 percent from the argon column.

3. A cryogenic air separation plant for producing gaseous oxygen comprising:

(A) a product boiler, means for supplying feed air to the product boiler, and means for passing liquid from the product boiler to a cryogenic rectification plant comprising a higher pressure column and a lower pressure column;

(B) means for passing liquid from the cryogenic rectification plant into the product boiler and means for recovering gaseous product from the product boiler;

(C) a liquid oxygen tank, a pump, means for passing liquid from the cryogenic rectification plant to the pump and from the pump into the liquid oxygen tank, and means for passing liquid from the liquid oxygen tank into the product boiler;

(D) a liquid air tank, means for passing liquid from the product boiler into the liquid air tank, and means for passing liquid from the liquid air tank into the cryogenic rectification plant and wherein the said means for passing liquid from the product boiler to the cryogenic rectification plant in clause (A) does not include the liquid air tank; and (E) a turboexpander, means for passing feed air into the turboexpander, and means for passing feed air from the turboexpander into the higher pressure column.

4. The cryogenic air separation plant of claim 3 further comprising an argon column, means for passing fluid from the cryogenic rectification plant into the argon column, and means for recovering fluid from the argon column.

5. The method of claim 1 further comprising cooling condensed feed air by indirect heat exchange with liquid oxygen prior to passing the condensed feed air into the cryogenic rectification plant.

6. The cryogenic air separation plant of claim 3 further comprising a heat exchanger, means for passing liquid from the product boiler to the heat exchanger, and means for passing liquid from the heat exchanger into the cryogenic rectification plant.

* * * * *